US007982559B2

(12) United States Patent
Mori et al.

(10) Patent No.: US 7,982,559 B2
(45) Date of Patent: Jul. 19, 2011

(54) STRIPLINE FILTER

(75) Inventors: Hirotsugu Mori, Kusatsu (JP); Motoharu Hiroshima, Nomi (JP)

(73) Assignee: Murata Manufacturing Co., Ltd., Kyoto-fu (JP)

( * ) Notice: Subject to any disclaimer, the term of this patent is extended or adjusted under 35 U.S.C. 154(b) by 0 days.

(21) Appl. No.: 12/819,599

(22) Filed: Jun. 21, 2010

(65) Prior Publication Data

US 2010/0244990 A1 Sep. 30, 2010

Related U.S. Application Data

(63) Continuation of application No. PCT/JP2008/072745, filed on Dec. 15, 2008.

(30) Foreign Application Priority Data

Jan. 17, 2008 (JP) ..... 2008-007580

(51) Int. Cl.
*H01P 1/203* (2006.01)
*H01P 1/205* (2006.01)

(52) U.S. Cl. ..... 333/204; 333/203

(58) Field of Classification Search ..... 333/165–167, 333/175, 176, 185, 202–205
See application file for complete search history.

(56) References Cited

U.S. PATENT DOCUMENTS 6,313,719 B1 * 11/2001 Barnett et al. ..... 333/204
6,326,866 B1 12/2001 Sasaki et al.
2001/0054943 A1 12/2001 Takeda
2003/0132820 A1 * 7/2003 Shamsaifar et al. ..... 333/205
2008/0224800 A1 * 9/2008 Takei et al. ..... 333/204

FOREIGN PATENT DOCUMENTS

JP 11-205005 A 7/1999
JP 2000-252705 A 9/2000
JP 2001-358501 12/2001
JP 2002-335111 A 11/2002
JP 2002-76703 A 9/2003

OTHER PUBLICATIONS

PCT/JP2008/072745 International Search Report dated Mar. 3, 2009.
PCT/JP2008/072745 Written Opinion dated Mar. 3, 2009.

* cited by examiner

*Primary Examiner* — Benny Lee
*Assistant Examiner* — Gerald Stevens
(74) *Attorney, Agent, or Firm* — Dickstein Shapiro LLP

(57) ABSTRACT

A stripline filter with wide-band filter characteristics having an attenuation pole on a high frequency side of frequency characteristics. The stripline filter includes at least three resonant lines, and two of the resonant lines include parallel line parts and bent parts. The third resonant line has a U shape in which both ends thereof are open and interdigitally coupled to the two resonant lines located on both sides thereof. The parallel line parts extend from base ends connected to a ground electrode via side surface lines that are parallel to respective line parts of the third resonant line. The bent parts extend so as to be bent from ends of the parallel line parts, and face each other at an interval.

7 Claims, 7 Drawing Sheets

STRIPLINE FILTER

CROSS REFERENCE TO RELATED APPLICATIONS

The present application is a continuation of International Application No. PCT/JP2008/072745, filed Dec. 15, 2008, which claims priority to Japanese Patent Application No. JP2008-007580, filed Jan. 17, 2008, the entire contents of each of these applications being incorporated herein by reference in their entirety.

FIELD OF THE INVENTION

The present invention relates to a stripline filter in which striplines are provided on a dielectric substrate.

BACKGROUND OF THE INVENTION

A stripline filter having filter characteristics suitable for a communication system that uses a wide band in a high frequency band, is known (see Patent Document 1).

FIG. 1 shows a configuration of an existing stripline filter. The stripline filter 101 is a filter that uses three resonators. The three resonators are constituted of lines 102, 103A, and 103B, respectively, provided on the same principal surface of a dielectric substrate. The line 102 is bent in U shape, and its ends are open. The lines 103A and 103B each has an I shape in which one end is connected to a ground electrode 105, and their ends are open. These resonators are interdigitally coupled to each other, and input/output transmission lines 104A and 104B are connected to the lines 103A and 103B, respectively. In this configuration, the resonators are strongly coupled to each other by being interdigitally coupled to each other, thereby achieving expansion of the band of the filter characteristics.

Patent Document 1: Japanese Unexamined Patent Application Publication No. 2001-358501

Due to development of UWB (ultra wide band) communication and the like, there is a demand for further expansion of the bands of stripline filters. However, in existing stripline filters, due to constraints on element size and the like, there are limitations on the line lengths of striplines and the degree of coupling between resonators, and there is also a limitation on expansion of bands.

Moreover, it is difficult to optionally set an attenuation pole and the like while achieving wide-band frequency characteristics. Particularly, it is difficult to provide an attenuation pole on a high frequency side of the band and to finely set its pole frequency.

SUMMARY OF THE INVENTION

Therefore, an object of the invention is to provide a stripline filter with wide-band filter characteristics having an attenuation pole on a high frequency side of frequency characteristics.

A stripline filter of the invention includes a ground electrode, a plurality of resonant lines, side surface lines, and an input/output electrode. Further, the stripline filter includes a first resonant line, a second resonant line, and a third resonant line, each of the second and third resonant lines has a parallel line part and a bent part.

Here, the first resonant line has a U shape in which both ends thereof are open and is interdigitally coupled to the second and third resonant lines. The parallel line parts of the second and third resonant lines extend from base ends connected to the ground electrode via the side surface lines, in parallel to the firs resonant line. The bent parts of the second and third resonant lines extend so as to be bent from ends of the parallel line parts and face each other at an interval.

In this configuration, the second and third resonant lines constitute a ¼ wavelength resonator. These resonant lines bend their ends, thereby reducing the area of a substrate. By adjusting the line lengths and the line widths of the parallel line parts and the line lengths and the line widths of the bent parts, the resonator length of the ¼ wavelength resonator can be set to be in a very wide range, thereby increasing flexibility in setting the degree of coupling with the second resonant line.

Further, by causing the bent parts of the second resonant line and the third resonant line to face each other, jump coupling occurs between the ends of these electrodes. Due to this jump coupling between the ends, the second resonant line and the third resonant line are capacitively coupled to each other, and hence an attenuation pole can be caused to occur on a high frequency side of frequency characteristics. The coupling amount of this jump coupling can be adjusted in a wide range by adjusting the dimension of the electrode interval between the bent parts and the facing length thereof.

The bent part may have a line width narrower than the parallel line part. When the line width of the bent part is narrower than the parallel line part, the line length of the resonant line is determined substantially by the line length of the parallel line part. Thus, the amount of the jump coupling can be set substantially independently of the line length of the resonant line.

It is preferred that at least one of the side surface lines is separated from the plurality of resonant lines and an electrode shape on each side surface is the same as an electrode shape on a side surface opposed thereto. This is because, when forming the side electrodes, there is no need to control the orientation of the substrate, and the stripline filter can be configured by a simple process.

The stripline filter may include an electrode that is connected to the side surface line separated from the plurality of the resonant lines, located on a top surface of the dielectric substrate, and is separated from the plurality of the resonant lines. Even when there are positional errors when cutting the dielectric substrate in the manufacturing process, the interval between this electrode and the resonant line is stabilized, and hence the frequency characteristics can be stabilized.

The stripline filter may include a capacitance addition electrode that generates a capacitance between the capacitance addition electrode and the second resonant line and generates a capacitance between the capacitance addition electrode and the third resonant line. Thus, the amount of the jump coupling can be enhanced.

The electrodes on the top surface of the dielectric substrate may be photosensitive electrodes, and the electrodes on a bottom surface and side surfaces of the dielectric substrate may be non-photosensitive electrodes. Thus, the cost of the process for forming the ground electrode and the side surface lines can be reduced while the resonant lines that have a great effect on the filter characteristics are formed with high accuracy.

According to the invention, the bent parts are provided at the open ends of the ¼ wavelength resonator and the bent parts are caused to face each other to generate jump coupling. Thus, an attenuation pole can be caused to occur on the high frequency side of the frequency characteristics while the line length of the ¼ wavelength resonator and the degree of the coupling between the resonators are increased.

REFERENCE NUMERALS

Figure 1:
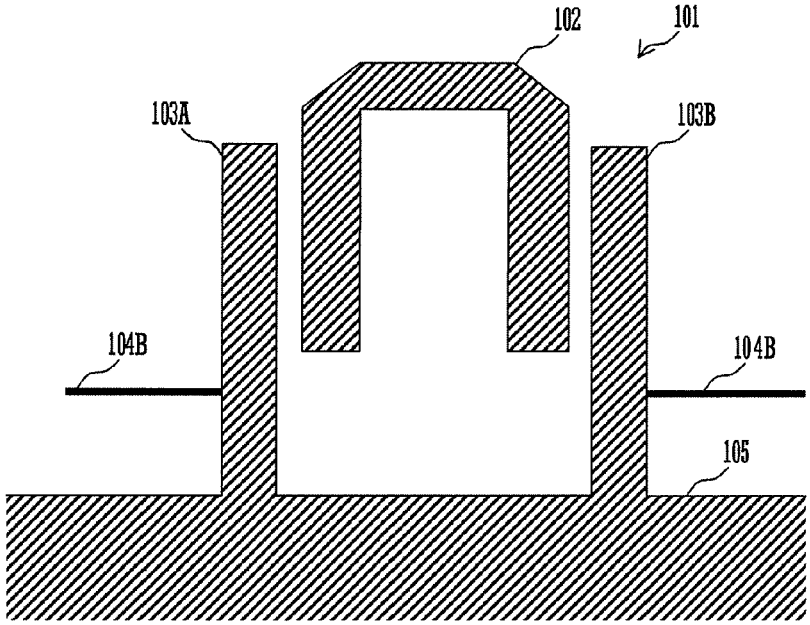
FIG. 1 PRIOR ART
FIG. 1 illustrates an example of a configuration of an existing stripline filter.

1, 21, 41, 51 stripline filter
2 glass layer
3 dielectric substrate
4A to 4F side surface line
5A side surface projecting electrode
6A, 6B input/output electrode
7 ground electrode
8C ½ wavelength resonant line
8A, 8B ¼ wavelength resonant line
9A dummy electrode end part
10A, 10B top surface projecting electrode
11A, 11B parallel line part
12A, 12B bent part
13A to 13I line part
21 stripline filter
22A, 22B bent part
41 stripline filter
42A, 42B bent part

DETAILED DESCRIPTION OF THE INVENTION

The following will describe examples of a configuration of a stripline filter according to an embodiment of the invention.

The stripline filter shown herein is a band-pass filter. The filter shown herein is used for UWB communication in a high frequency band equal to or higher than 3 GHz.

Figure 2:
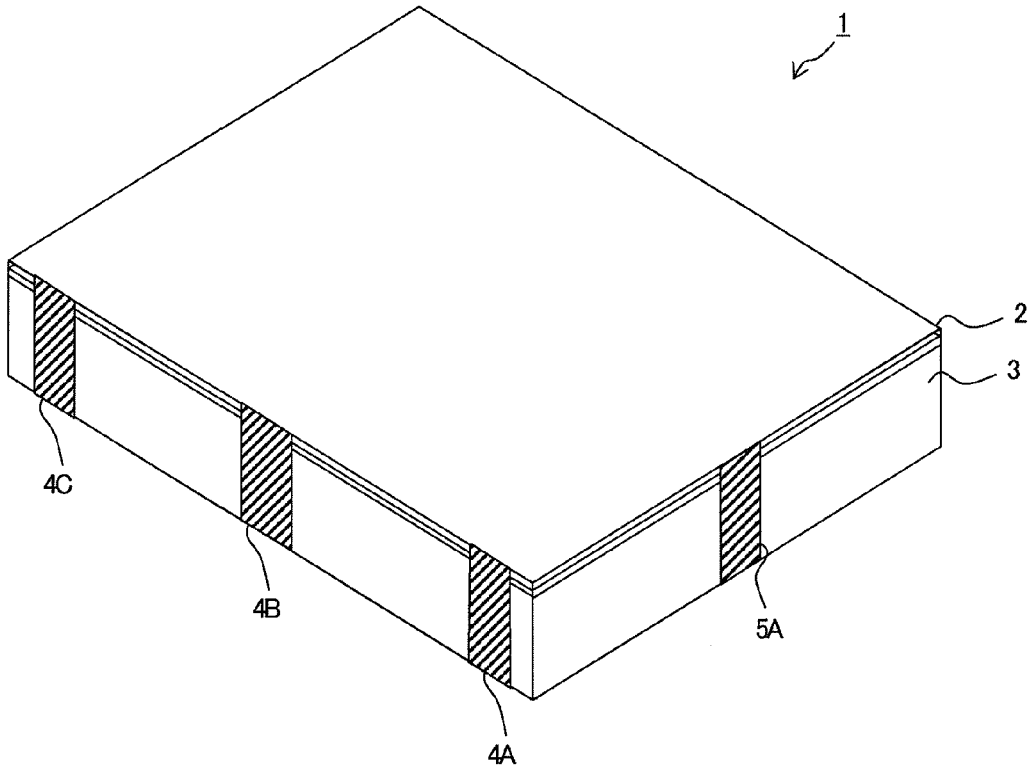
FIG. 2 is a perspective view of a stripline filter according to an embodiment on its top surface side.

FIG. 2 is a perspective view of the stripline filter on its top surface side.

The stripline filter 1 includes a dielectric substrate 3 and a glass layer 2. The substrate 3 is a small rectangular-parallelepiped-shaped, ceramic sintered substrate that is formed from titanium oxide and the like and has a relative dielectric constant of about 111. The composition and the dimension of the substrate 3 are set as appropriate by taking into consideration frequency characteristics and the like. The glass layer 2 is a layer having a thickness of about 15 μm in which a translucent glass and a light blocking glass are laminated, and is laminated on a top surface of the dielectric substrate 3 for the purposes of mechanical protection and improvement of the environmental resistance, of the stripline filter 1, and the like. Note that the glass layer 2 may not necessarily be provided.

On side surfaces of the stripline filter 1 shown in the drawing, side surface lines 4A to 4C and a side surface projecting electrode 5A are provided. Further, on a side surface opposed to the side surface on which the side surface lines 4A to 4C are provided, side surface lines 4D to 4F (see FIG. 3) are provided so as to be the same as the side surface lines 4A to 4C. On a side surface opposed to the side surface on which the side surface projecting electrode 5A is provided, a side surface projecting electrode (that is not shown in the drawing) is provided so as to be the same as and opposed to the side surface projecting electrode 5A.

Figure 3:
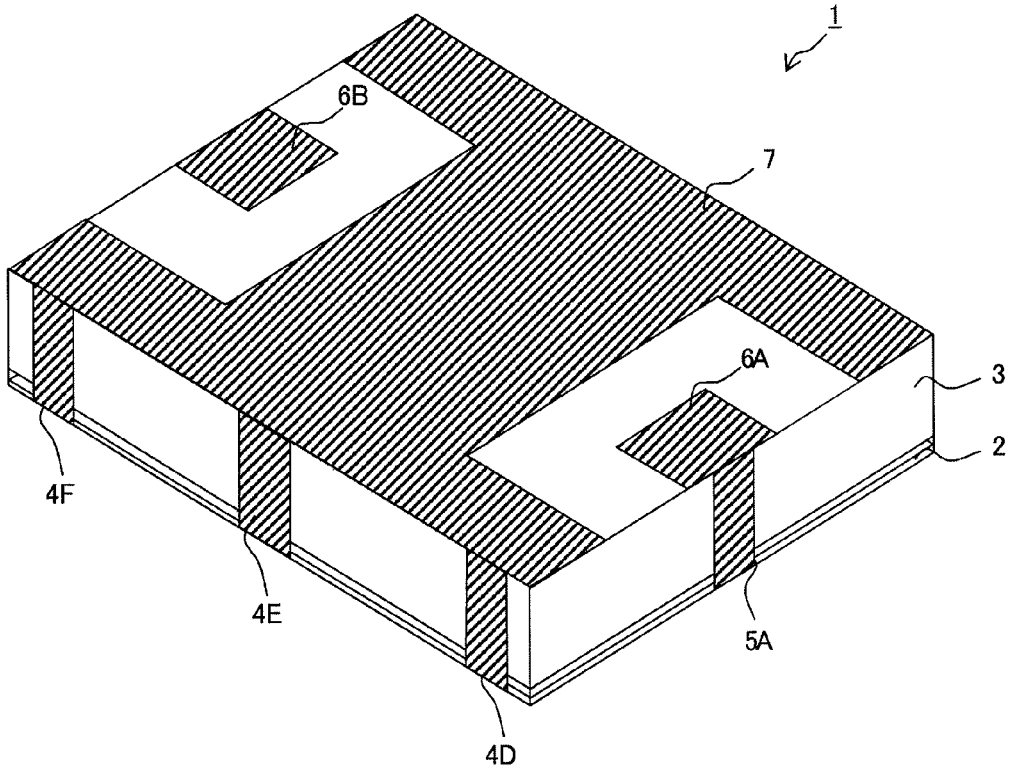
FIG. 3 is a perspective view of the stripline filter on its bottom surface side.

FIG. 3 is a perspective view of the stripline filter on its bottom surface side. On the side surfaces shown in this drawing, the side surface lines 4D to 4F and the side surface projecting electrode 5A are provided.

A bottom surface of the dielectric substrate 3 is a mounted surface of the stripline filter 1, and has a ground electrode 7 and input/output electrodes 6A and 6B. The input/output electrodes 6A and 6B are connected to high-frequency signal input/output terminals when the stripline filter 1 is mounted on a mounting board. The ground electrode 7 has a ground surface for a resonator, and is connected to a ground electrode on the mounting board.

The ground electrode 7 is provided on the substantially entire bottom surface of the dielectric substrate 3, and the input/output electrodes 6A and 6B are provided in electrode-unformed portions provided in the ground electrode 7, so as to be separated from the ground electrode 7. The side surface lines 4A to 4F are connected to the ground electrode 7. The side surface projecting electrode 5A is connected to the input/output electrode 6A. The other side surface projecting electrode (opposite to 5A) is connected to the input/output electrode 6B. These electrodes are silver electrodes each having a thickness of about 12 μm or greater, and are formed by: applying a non-photosensitive silver paste to the substrate 3 by using a screen mask, a metal mask, or other applying means; and performing burning.

Figure 4:
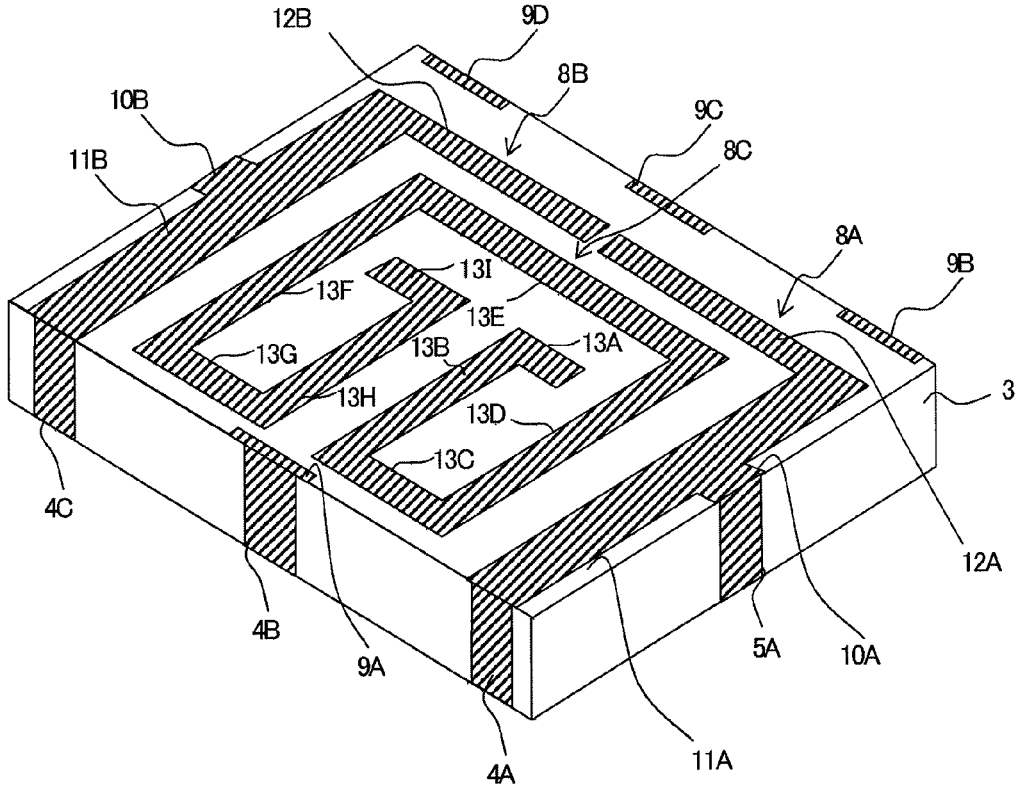
FIG. 4 is a perspective view of a dielectric substrate of the stripline filter on its top surface side.

FIG. 4 is a perspective view of the dielectric substrate other than the glass layer, on its top surface side.

On the top surface of the dielectric substrate 3, dummy electrode end part 9A to 9D, top surface projecting electrodes 10A and 10B, ¼ wavelength resonant lines 8A and 8B, and a ½ wavelength resonant line 8C are provided. The ½ wavelength resonant line 8C is located between the ¼ wavelength resonant line 8A and the ¼ wavelength resonant line 8B. These electrodes are silver electrodes each having a thickness of about 5 μm or greater, and are formed by: applying a photosensitive silver paste to the substrate 3; forming a pattern by a photolithographic process; and performing burning. By forming these electrodes as the photosensitive silver electrodes, the shape accuracy of the electrodes is increased to provide a stripline filter that can be used for UWB communication.

The ¼ wavelength resonant line 8A includes a parallel line part 11A and a bent part 12A. The ¼ wavelength resonant line 8B includes a parallel line part 11B and a bent part 12B. The parallel line parts 11A and 11B are connected to the side surface lines 4A and 4C at their base ends, respectively. The bent parts 12A and 12B are bent perpendicularly from ends of the parallel line parts 11A and 11B, and their ends face each other. The ends of the ¼ wavelength resonant lines 8A and 8B are open, and the ¼ wavelength resonant lines 8A and BE correspond to second and third resonant lines. Here, the line widths of the parallel line parts 11A and 11B are adjusted to achieve required frequency characteristics, and are greater than the line widths of the bent parts 12A and 12B. Thus, the resonator length of a resonator constituted of the ¼ wavelength resonant lines 8A and 8B are determined mainly by the line lengths and the line widths of the parallel line parts 11A and 11B.

The ½ wavelength resonant line 8C is constituted of line parts 13A to 13I. The line part 13E is provided so as to extend in parallel to the bent parts 12A and 12B of the ¼ wavelength resonant lines 8A and 8B. The line parts 13D and 13F are provided so as to extend from both ends of the line part 13E in parallel to the parallel line parts 11A and 11B of the ¼ wavelength resonant lines 8A and 8B, respectively. The line parts 13C and 13G are provided on the opposite side of the line part 13E so as to be bent perpendicularly from ends of the line parts 13D and 13F, respectively, and so as to extend toward a substrate center side. The line parts 13B and 13H are provided so as to be bent perpendicularly from ends of the line parts 13C and 13G, respectively, and so as to extend toward the substrate center side. The line parts 13A and 13I are provided so as to be bent perpendicularly from ends of the line parts 13B and 13H, respectively, and so as to extend toward a substrate external side, and their ends are open. The ½ wavelength resonant line 8C corresponds to a first resonant line. Here, by forming the ½ wavelength resonant line 8C in a U shape in which the ½ wavelength resonant line 8C is bent multiple times, the line length is extended.

The top surface projecting electrodes 10A and 10B are connected to the respective side surface projecting electrodes (i.e., 5A). Thus, a resonator constituted of the second resonant line 8A is tap-coupled to the input/output electrode 6A and a resonator constituted of the third resonant line 8B is tap-coupled to the input/output electrode 6B, thereby achieving strong external coupling.

The dummy electrode end parts 9A to 9D are connected to the side surface lines 4B and 4D to 4F, respectively. These pairs of the dummy electrode end parts 9A to 9D and the side surface lines 4B and 4D to 4F constitute dummy electrodes, respectively. These dummy electrodes are unnecessary for the circuit configuration of the stripline filter 1, but are provided to cause the electrode shapes on the opposing side surfaces of the stripline filter 1 to be the same. Thus, in a process of forming the electrodes on the side surfaces, it is unnecessary to control the orientation of the dielectric substrate, and the electrodes can be easily formed on the side surfaces. In addition, when a chip element of another circuit configuration is configured with the same substrate size and the same side surface electrode shape, the process of forming the electrodes on the side surfaces can be shared.

Note that only for causing the electrode shapes on the side surfaces to be the same, it is not necessary to provide the dummy electrode end part 9A to 9D. However, if a cutting position of the dielectric substrate 3 is deviated during manufacturing of the stripline filter 1, the interval dimension between the resonant lines 8A to 8C and the dummy electrodes are changed and electrical characteristics are destabilized when the dummy electrode end parts 9A to 9D are not provided. Thus, by providing the dummy electrode end parts 9A to 9D, the change of the interval dimension can be prevented even when the cutting position of the dielectric substrate 3 is deviated during manufacturing of the stripline filter 1, and the electrical characteristics can be stabilized.

Further, here, at portions where the electrodes on the top surface are connected to the electrodes on the side surfaces, the electrodes on the top surface are wider. This is for preventing the connecting widths of the electrodes on the top surface and the side surfaces from being changed, even when deviation of position occurs during forming of the electrodes on the side surfaces. Due to this configuration, the connecting widths of the electrodes are stabilized, and hence the electrical characteristics of the stripline filter 1 can be stabilized more.

Due to the above configuration, the stripline filter 1 becomes a band-pass filter in which resonators of three stages are coupled to each other. Here, the facing directions of the open ends of the resonant lines 8A and 8B are opposite to the facing directions of the open ends of the resonant line 8C, and the resonators constituted of these resonant lines are interdigitally coupled to each other. Thus, coupling between the resonators becomes strong, and the passband of the stripline filter 1 can be expanded.

Note that the thickness of the electrodes on the side surfaces is larger than the thickness of the electrodes on the top surface, whereby a current at a part, on the ground terminal side, where current crowding generally occurs is dispersed and conductor loss is reduced. Due to this configuration, the stripline filter 1 becomes an element having a small insertion loss.

On the top surface of the substrate 3, the bent parts 12A and 12B of the resonant lines 8A and 8B face each other. Thus, a capacitance corresponding to the interval between the bent parts 12A and 12B and the facing length thereof, occurs between the bent parts 12A and 12B. This capacitance causes the second resonant line 8A to be jump-coupled to the third resonant line 8B. The bent parts 12A and 12B provide a capacitance at the open ends of the resonant lines 8A and 8B. Thus, the resonators constituted of the resonant lines 8A and 8B are capacitively coupled to each other, and an attenuation pole occurs on a high frequency side of the passband of the stripline filter 1.

Further, the bent parts 12A and 12B of the resonant lines 8A and 8B face each other so as to be spaced from the resonant line 8C. Thus, as compared to when the bent parts 12A and 12B are not provided, the coupling between the resonant line 8A and the resonant line 8C and the coupling between the resonant line BE and the resonant line 8C are very strong. Therefore, the passband of the stripline filter 1 is expanded more.

Figure 5:
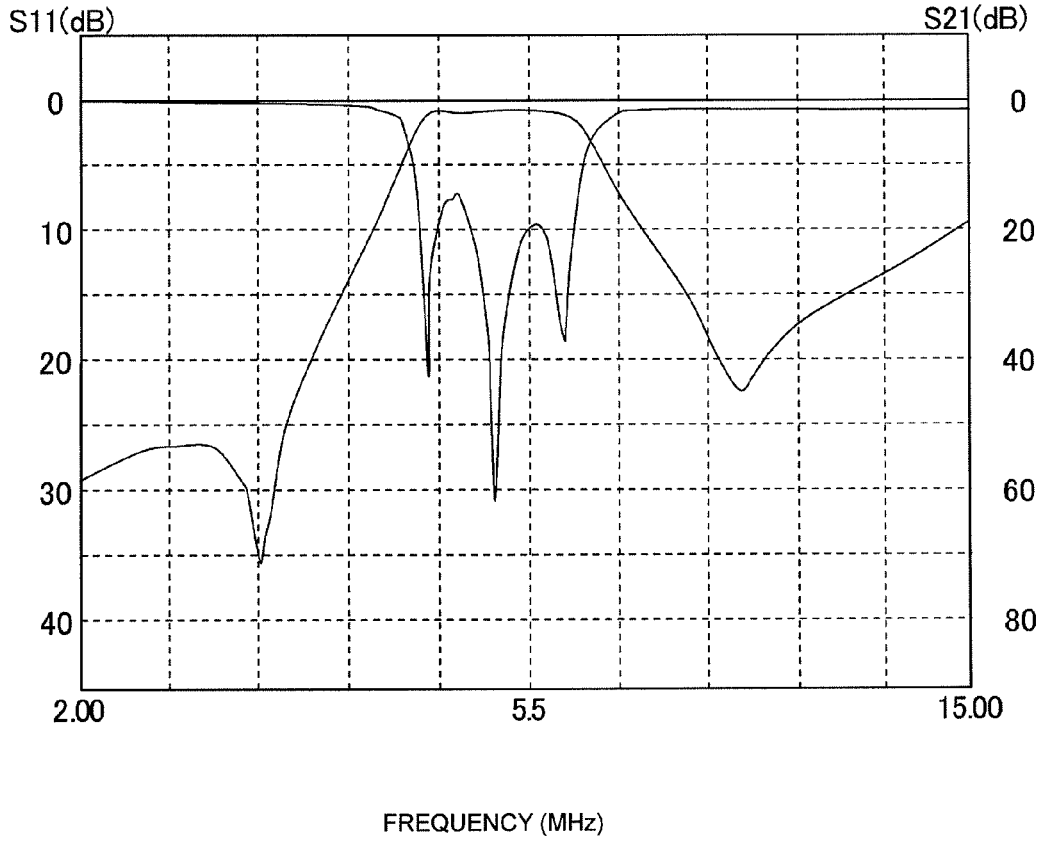
FIG. 5 illustrates an example of filter characteristics of the stripline filter.

FIG. 5 illustrates an example of filter characteristics of the stripline filter 1. In the graph in the drawing, the horizontal axis indicates a frequency, and the vertical axis indicates an amount of attenuation. The filter characteristics shown here are a result of a simulation. Here, the passband of the stripline filter 1 is set so as to be about 7.0 GHz to about 9.2 GHz.

As the result of the simulation, an attenuation pole occurs at a frequency of about 11.7 GHz on a high frequency side of the passband. This attenuation pole on the high frequency side of the passband occurs due to the jump coupling between the second resonant line 8A and the third resonant line 8B. In the filter of this configuration, the frequency characteristics abruptly fall on the high frequency side of the passband. Thus, only signals having a passband of about 7.0 GHz to about 9.2 GHz can be allowed to pass without allowing signals having other adjacent frequency bands to pass.

Note that, other than the electrode interval between the bent parts, by their facing length, the strength of the jump coupling can be also adjusted. Even with the same interval dimension, the capacitance between the bent parts can be increased by increasing the facing length. Thus, it is preferred that the capacitance between the bent parts is increased by widening the line widths only at the end portions of the bent parts.

The following will describe a manufacturing process of the stripline filter 1.

Figure 6:
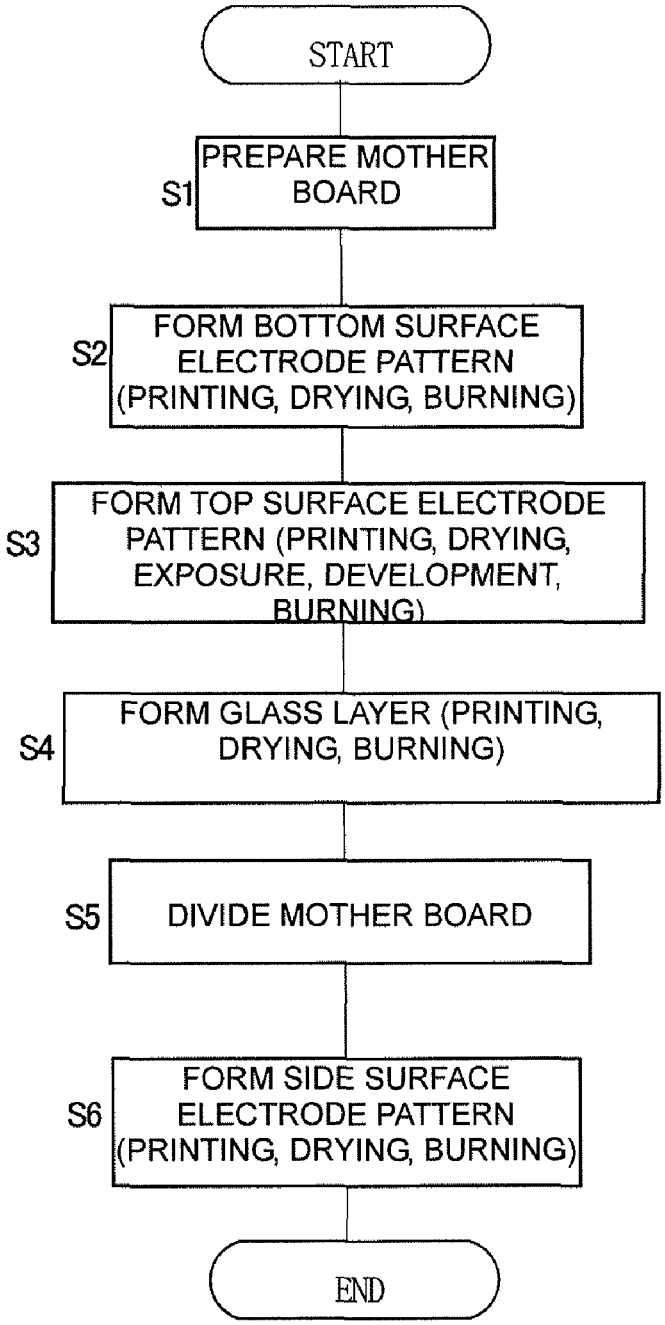
FIG. 6 illustrates a manufacturing process of the stripline filter.

FIG. 6 illustrates a flow of the manufacturing process of the stripline filter 1.

(S1) First, a dielectric motherboard is prepared in which no electrode is formed on any surface.

(S2) Next, a conductive paste is printed on a bottom surface of the dielectric motherboard by screen printing or metal mask printing, and burnt to form the ground electrode 7 and the input/output electrodes 6A and 6B.

(S3) Next, a photosensitive conductive paste is printed on a top surface of the dielectric motherboard, a photolithographic process involving exposure and development is performed, and then burning is performed to form the resonant lines 8A to 8C, the dummy electrode end parts 9A to 9D, and the top surface projecting electrodes 10A and 10B. In the photolithographic process, the electrodes can be thinned to about 30 μm and can be formed with very high position accuracy.

(S4) Next, a glass paste is printed on the top surface side of the dielectric motherboard, and burnt to form a transparent glass layer. The glass layer 2 is formed by this process.

(S5) Next, multiple dielectric substrates 3 are cut out of the dielectric motherboard configured thus, by dicing or the like.

(S6) Next, the dielectric substrates 3 are arranged, a process is performed in which: a conductive paste is printed by a metal mask or screen mask of a predetermined pattern; or a conductive paste is applied by using other application means, and burning is performed to form electrodes. By performing this electrode forming process on each side surface, the side surface projecting electrodes (i.e., 5A) and the side surface lines 4A to 4F are formed. In this printing process, the electrodes can be thinned to merely about 100 μm and can be formed with merely low position accuracy as compared to that in the photolithographic process.

The stripline filter 1 is manufactured by the above process.

Note that, for example, by adjusting the dimension of the electrode interval between the bent parts by cutting after the above process, it is also possible to adjust the coupling amount of the jump coupling. When such adjustment is performed, the pole frequency of the attenuation pole on the high frequency side of the passband can be set finely.

The following will describe filter characteristics in a configuration that is different from the above stripline filter 1 in the electrode interval between the bent parts.

Figure 7:
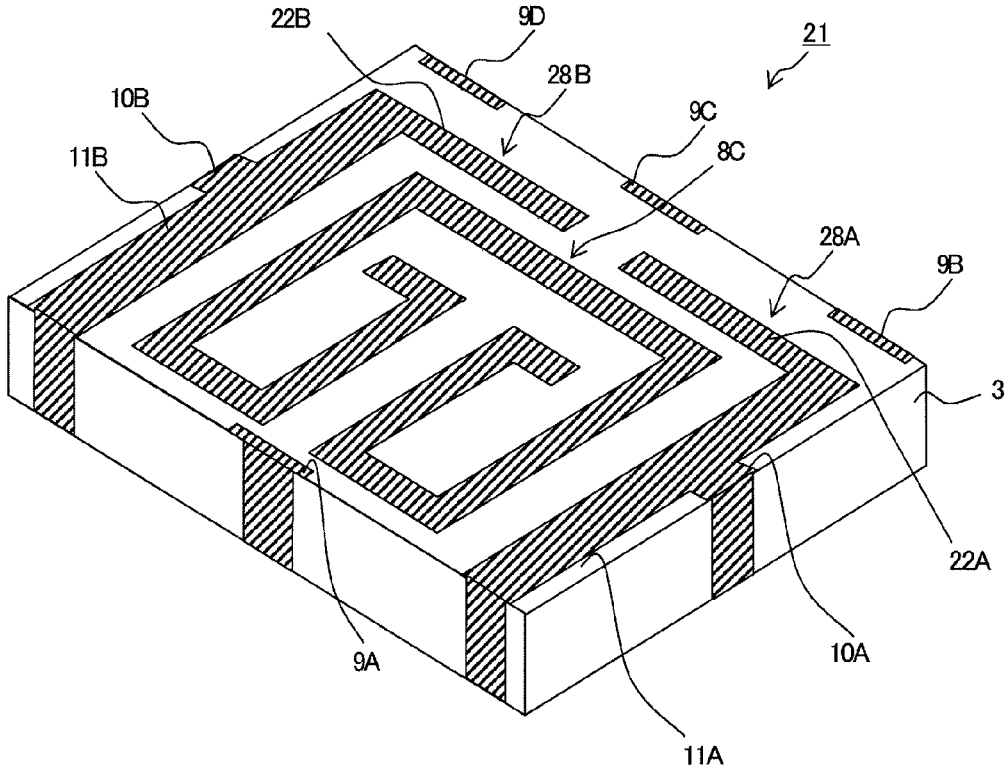
FIG. 7 illustrates another example of a configuration of a stripline filter.

FIG. 7 is a perspective view illustrating another configuration of a stripline filter. Note that, in this drawing, the same configurations as those of the above stripline filter 1 are designated by the same reference numerals. A stripline filter 21 shown herein is configured such that the line lengths of bent parts 22A and 22B are shorter than those of the stripline filter 1 and the electrode interval between the bent parts 22A and 22B is large.

In this case, the bent parts 22A and 22B face each other at a large interval, and hence a low capacitance occurs between the bent parts 22A and 22B as compared to that in the stripline filter 1. This capacitance causes the second resonant line 8A to be jump-coupled to the third resonant line 8B, but an attenuation pole of the stripline filter 21 on the high frequency side of the passband is slightly away from the passband.

Figure 8:
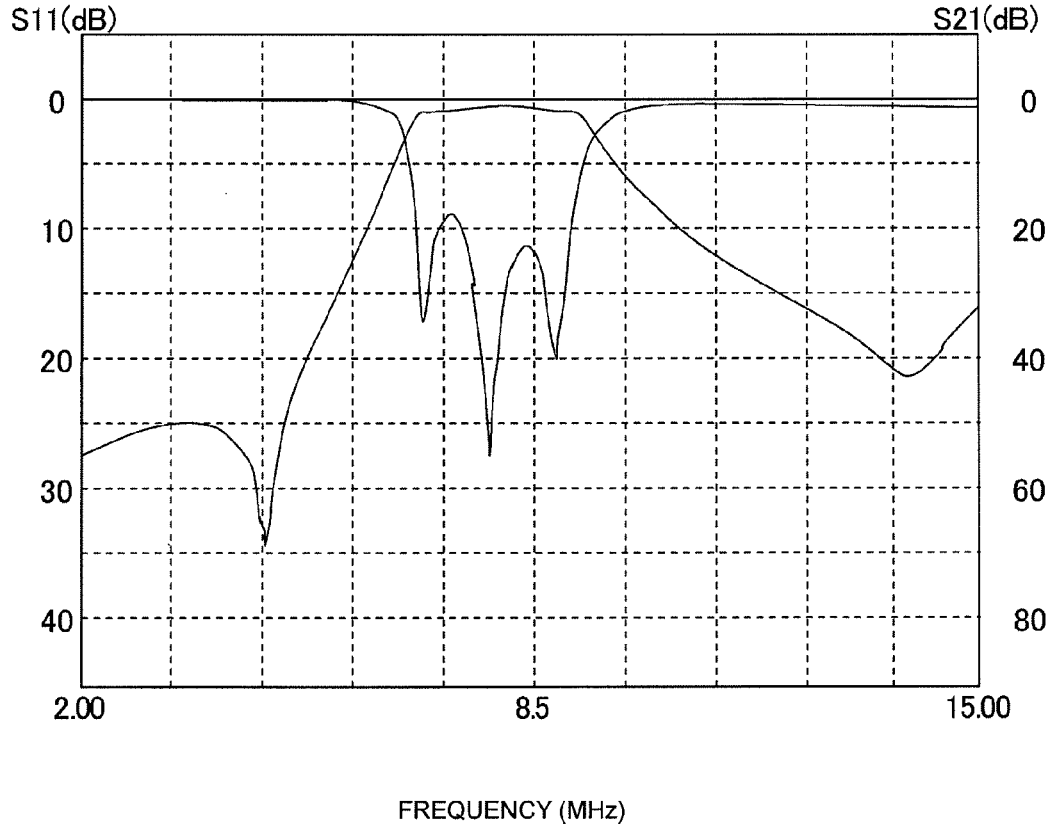
FIG. 8 illustrates an example of filter characteristics of the stripline filter.

FIG. 8 illustrates an example of filter characteristics of the stripline filter 21. In the graph in the drawing, the horizontal axis indicates a frequency, and the vertical axis indicates an amount of attenuation. The filter characteristics shown here are a result of a simulation. Here, the passband of the stripline filter 21 is set so as to be about 7.0 GHz to about 9.2 GHz.

As the result of the simulation, an attenuation pole occurs at a frequency of about 14.0 GHz on the high frequency side of the passband. In this configuration, the frequency characteristics gradually fall on the high frequency side of the passband. Thus, signals having a passband of about 7.0 GHz to about 9.2 GHz can be mainly allowed to pass without allowing signals having frequency bands around about 14.0 GHz of the attenuation pole to pass.

Figure 9:
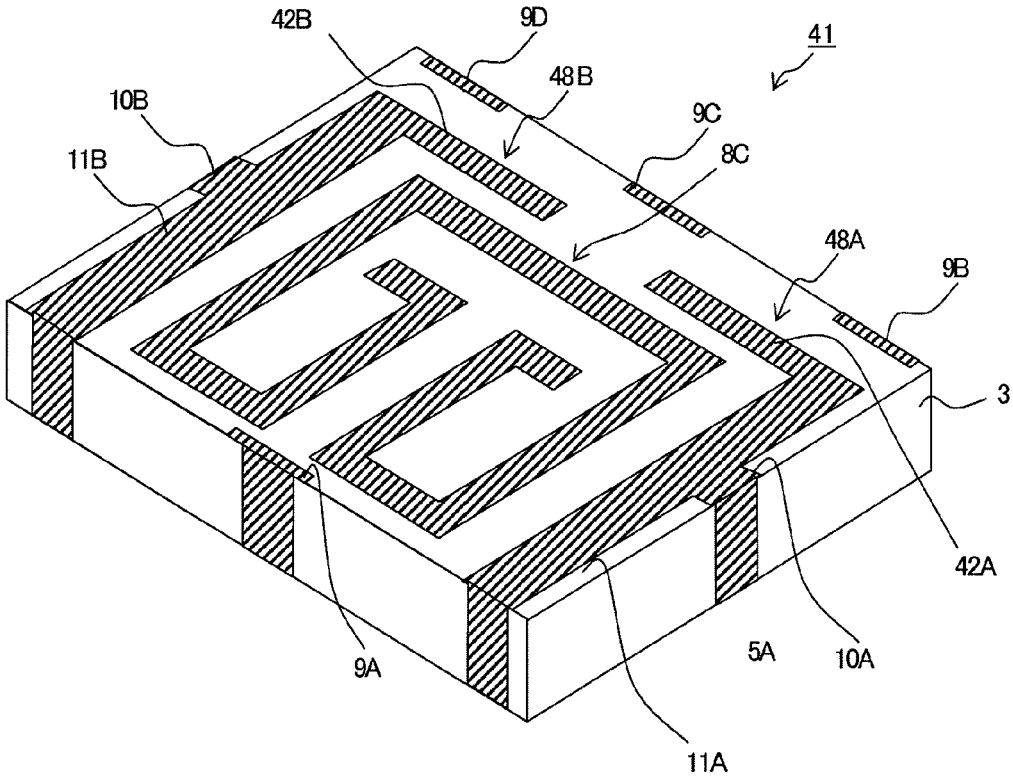
FIG. 9 illustrates another example of a configuration of a stripline filter.

FIG. 9 is a perspective view illustrating another configuration of a stripline filter. Note that, in this drawing, the same configurations as those of the above stripline filter 1 are designated by the same reference numerals. A stripline filter 41 shown here is configured such that the line lengths of bent parts 42A and 42B are shorter than those of the stripline filter 21 and the electrode interval between the bent parts 42A and 42B is larger.

In this case, the bent parts 42A and 42B face each other at a larger interval, and hence a lower capacitance occurs between the bent parts 42A and 42B as compared to those in the stripline filter 1 and the stripline filter 21. This capacitance causes the second resonant line 8A to be jump-coupled to the third resonant line 8B, but an attenuation pole of the stripline filter 41 on the high frequency side of the passband is further away from the passband.

Figure 10:
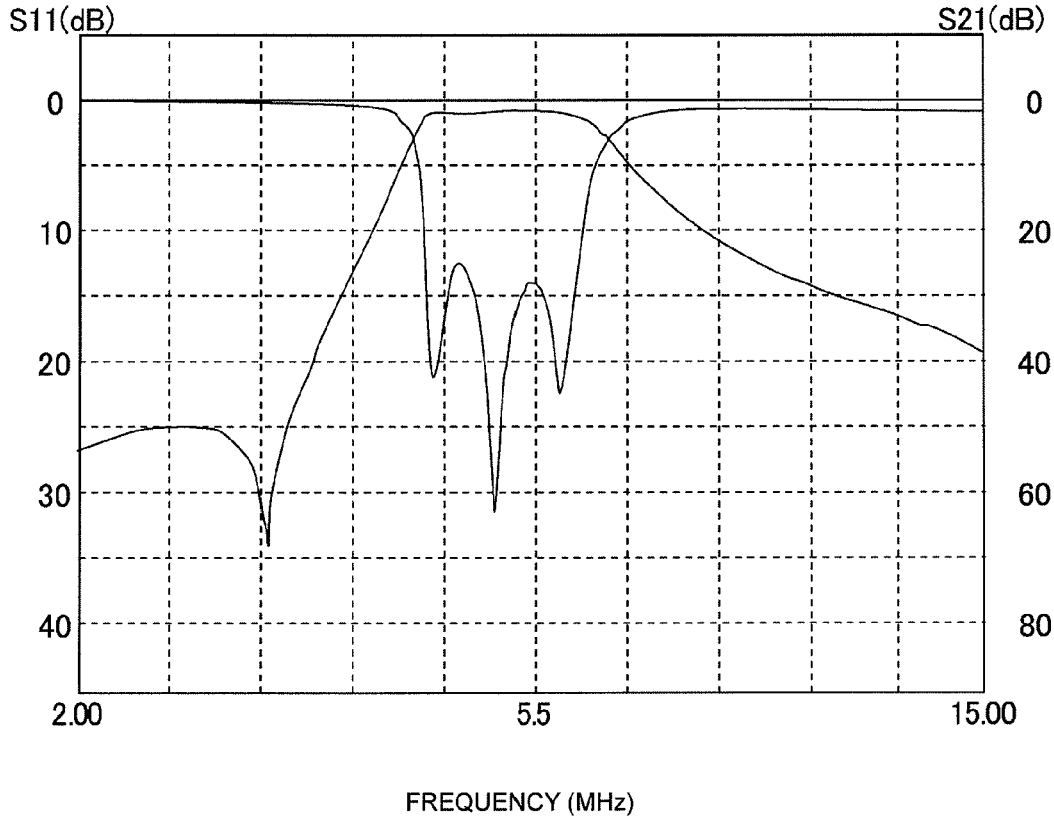
FIG. 10 illustrates an example of filter characteristics of the stripline filter.

FIG. 10 illustrates an example of filter characteristics of the stripline filter 41. In the graph in the drawing, the horizontal axis indicates a frequency, and the vertical axis indicates an amount of attenuation. The filter characteristics shown here are a result of a simulation. Here, the passband of the stripline filter 41 is set so as to be about 7.0 GHz to about 9.2 GHz.

As the result of the simulation, an attenuation pole occurs at a frequency higher that 14.0 GHz on the high frequency side of the passband. In this configuration, the frequency characteristics gradually fall on the high frequency side of the passband. Thus, signals having a passband of about 7.0 GHz to about 9.2 GHz can be mainly allowed to pass without allowing signals having frequency bands around the attenuation pole to pass.

The following will describe another embodiment of a stripline filter.

Figure 11:
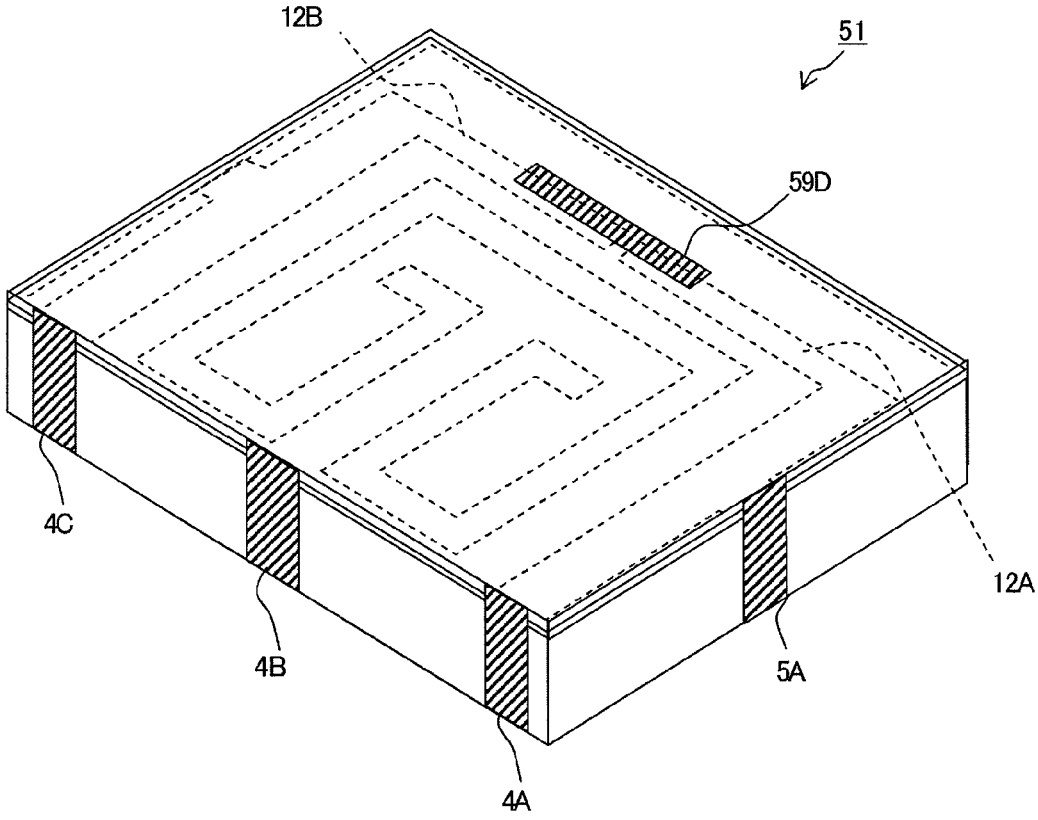
FIG. 11 is a perspective view of a stripline filter according to another embodiment.

FIG. 11 is a perspective view of a stripline filter 51. Here, the same configurations as those of the above stripline filter 1 are designated by the same reference numerals. The stripline filter 51 shown here is configured such that a capacitance addition electrode 59D is provided on the glass layer 2 facing the bent parts 12A and 12B, in order to increases the number of capacitances between the bent parts 12A and 12B. In this configuration, the number of capacitances between the bent parts 12A and 12B can be increased further. Thus, in this configuration, the jump coupling is enhanced, and the attenuation pole on the high frequency side can be closer to the pass characteristics.

As shown above, the frequency of the attenuation pole on the high frequency side can be optionally set by adjusting the capacitance between the bent parts. The adjustment of the capacitance between the bent parts can be performed independently of the line lengths of the resonant lines and the coupling between the resonators. Thus, it is possible to achieve wide-band filter characteristics having an attenuation pole on the high frequency side of the frequency characteristics.

Note that the arranged positions and the shapes of the top surface resonant lines and the projecting electrodes in the above embodiments are according to the product specifications, and may be any arranged positions and shapes according to the product specifications. For example, in addition to the configuration in which a plurality of resonators are interdigitally coupled to each other, a configuration in which a plurality of resonators are comb-line coupled to each other, may be used. The invention is applicable to a configuration other than the above configurations, and can be used for pattern shapes of various filters. Further, another configuration (a high-frequency circuit) may be provided to the filter.

The invention claimed is:

1. A stripline filter comprising:

a dielectric substrate having a top surface, a bottom surface opposite the top surface, and side surfaces connecting the top and bottom surfaces;

a ground electrode on the bottom surface of the dielectric substrate;

a plurality of resonant lines on the top surface of the dielectric substrate;

side surface lines on at least one of the side surfaces of the dielectric substrate and the side surface lines are connected to at least the ground electrode; and an input/output electrode coupled to a resonator formed by a resonant line of the plurality of resonant lines, wherein the plurality of resonant lines include a first resonant line having a U shape in which ends thereof are open and which is interdigitally coupled to second and third resonant lines located on opposed sides thereof, each of the second and third resonant lines has (1) a parallel line part that extends from a base end directly connected to a corresponding side surface line of the side surface lines, in parallel to the first resonant line; and (2) a bent part that extends so as to be bent from an end of the parallel line part, and the bent part of the second resonant line and the bent part of the third resonant line face each other at an interval.

2. The stripline filter according to claim 1, wherein the bent part of each second and third resonant line has a line width narrower than the corresponding parallel line part.

3. The stripline filter according to claim 1, wherein at least one of the side surface lines is separated from the plurality of resonant lines, and an electrode shape of the side surface lines on each side surface is the same as an electrode shape on a side surface opposed thereto.

4. The stripline filter according to claim 3, further comprising an electrode connected to the at least one of the side surface lines, separated from the plurality of resonant lines, and located on the top surface of the dielectric substrate.

5. The stripline filter according to claim 1, further comprising a capacitance addition electrode that generates a first capacitance between the capacitance addition electrode and the second resonant line and a second capacitance between the capacitance addition electrode and the third resonant line.

6. The stripline filter according to claim 1, wherein the plurality of resonant lines on the top surface of the dielectric substrate are photosensitive electrodes, and the ground electrode on the bottom surface of the dielectric substrate and the side surface lines of the dielectric substrate are non-photosensitive electrodes.

7. The stripline filter according to claim 1, wherein the interval at which the bent part of the second resonant line and the bent part of the third resonant line face each other is such that an attenuation pole of the stripline filter on a high frequency side of a passband is away from the passband.

* * * * *